United States Patent [19]

Polit

[11] Patent Number: 4,589,945

[45] Date of Patent: May 20, 1986

[54] VACUUM SUPPLY CONTROL FOR A THREE PAD LABELLING HEAD MACHINE

[75] Inventor: Neil A. Polit, Crystal Lake, Ill.

[73] Assignee: Xerox Corporation, Stamford, Conn.

[21] Appl. No.: 752,322

[22] Filed: Jul. 5, 1985

[51] Int. Cl.[4] ..... B65C 9/18; B65C 9/42

[52] U.S. Cl. ..... 156/497; 156/521; 156/568; 156/578; 156/DIG. 28; 156/DIG. 33; 156/DIG. 45

[58] Field of Search ..... 156/362, 497, 521, 568, 156/571, 578, DIG. 28, DIG. 31, DIG. 33, DIG. 45

[56] References Cited

U.S. PATENT DOCUMENTS

| | | | |
|---|---|---|---|
| 3,367,822 | 2/1968 | Hoffler | 156/571 |
| 3,464,871 | 9/1969 | Smith | 156/568 |
| 3,723,228 | 3/1973 | Schaltegger | 156/571 |

FOREIGN PATENT DOCUMENTS

| | | | |
|---|---|---|---|
| 1090708 | 11/1964 | United Kingdom | 156/DIG. 33 |

*Primary Examiner*—Michael Wityshyn

*Attorney, Agent, or Firm*—Frederic E. McMullen

[57] ABSTRACT

A labelling machine with three pad head where during labelling of articles every other pad is skipped, each pad having vacuum holddown ports in the periphery to temporarily attach a label during the labelling process, a control valve for controlling admission of vacuum to each pad so that a label is attached to and carried by the pad into labelling relation with an article brought forward by a conveyor belt, and a vacuum distributing valve to limit the vacuum supply to the control valve so that no vacuum can be admitted by the control valve to a skipped pad thereby preventing undesirable loss of vacuum to the atmosphere through the absence of a label to close the pad holddown ports.

4 Claims, 13 Drawing Figures

30
40
80
81
84
85
89
90
97
36
50-1
50-2
50-3
65
66
67
70
71
72
73

30
40
80
81
84
85
89
90
97
36
50-1
50-2
50-3
65
66
67
70
71
72
73

VACUUM SUPPLY CONTROL FOR A THREE PAD LABELLING HEAD MACHINE

This invention relates to labelling machines, and more particularly, to an improved vacuum supply control for a three pad labelling head machine.

Labelling machines utilize a rotary labelling wheel with one or more pads on the circumference thereof which brings labels with address information thereon into a transfer relationship with the articles that are being labelled. The articles, which may comprise envelopes, magazines, and other media, are brought forward on a suitable transport. Labelling is normally accomplished either by gluing the label directly onto the article or by transferring the address information from the label to the article. In the later case, following transfer of the addressing information, the label is usually discarded.

Labelling machines of this type typically use a vacuum labelling wheel in which vacuum admitted at predetermined times during the labelling cycle picks up and attaches the label to the label wheel pad for transport into labelling relationship with an article brought forward by conveyor. To effectuate this without undesirable slipping or gathering of the label, the surface speed of the article and that of the label must be the same. And since the circumference of the label wheel controls spacing between labels, the articles being labelled should be fed at the precise spacing necessary to match and locate each label at the desired position on the article being labelled.

For example, a label wheel having a 20 inch (50.8 cm) circumference will apply labels at the same location on articles if the articles are moving at the surface speed of the label wheel and are spaced 20 inches (50.8 cm) apart. But, if one wishes to change label spacing, the circumference of the label wheel must be changed or vacuum must be supplied to other pads on the wheel to result in a spacing of 20/2, 20/3, 20/4, etc., where the demoninator is an integer. This normally requires modification to the machine castings and drive train and is thus virtually impossible to do in the field.

Labelling heads are usually mounted on a base which also serves as feeder for the articles to be labelled. Conventional bases of this type are typically designed to run either at 10 inch (25.4 cm) or 20 inch (50.8 cm) article spacing. Presuming therefore that the maximum surface speed of the article and label are the same, this base permits runs to be made at a rate of either 30,000 per hour at 10 inch (25.4 cm) spacing or at a rate of 15,000 per hour at 20 inch (50.8 cm) spacing. To achieve the latter, two opposed pads are installed on the label wheel so that where the machine is run on 10 inch (25.4 cm) spacing, both pads are used while at 20 inch (50.8 cm) spacing, only one pad is used.

It has been found however that for many commercial applications, the articles are delivered at a spacing other than conventional 10 inch (25.4 cm) or 20 inch (50.8 cm) spacing referred to above. Further, many users have articles that are 10 inch (25.4 cm) to 12 inch (30.5 cm) in length and hence are unhappy with the necessity of running articles of this size on 20 inch (50.8 cm) spacing and thus at the lower rate of 15,000 per hour. To obviate this, label wheels with three pads have been suggested. In that case, presuming that the labelling wheel has a 20 inch (50.8 cm) circumference, the spacing between the pads on the wheel would be 6.66 inch (16.91 cm). If every other pad were used, the effective spacing becomes 13.33 inches (33.86 cm) and this would allow articles as large as 12.5 inches (31.75 cm) to be labelled at the faster rate of 22,500 per hour. At the same time, the ability to label longer articles at 20 inch (50.8 cm) spacing is retained if every third pad is used.

Commercial labelling machines however are inherently timed so that vacuum is admitted to each label pad, and by design and arrangement to the machine parts, admitted over approximately 190° of label wheel rotation. Thus, even though only every second pad of a three pad head receives a label, vacuum is supplied to every pad. As a result, each time a pad is skipped, the pad vacuum holddown ports are, since there is no covering label, opened to the atmosphere with consequent loss and leakage of vacuum. Because the vacuum loss is relatively substantial, it is usually necessary that these machines be fitted with a larger capacity vacuum supply pump or that even that a second vacuum pump be added it an adequate supply of vacuum is to be assured.

To avoid the above and enable a three pad head to operate in an alternate label pad skipping mode without loss of vacuum, the present invention provides, in an article labelling apparatus having an article labelling station whereat articles are labelled, the combination of: a supply of articles to be labelled; article transport means for transporting the articles to the article labelling station for labelling; a label supply station; means to supply individual labels to the label supply station; a rotary labelling wheel operatively disposed between the label supply station and the article labelling station having three labelling pads on the wheel periphery, each pad having at least one vacuum holddown port for temporarily attaching a label from the label supply station to the pad for transport by the pad into labelling relationship with the article being labelle at the article labelling station; a source of vacuum; a vacuum control valve for communicating the label holddown port of each pad with the vacuum source to enable a label from the label source to be attached to the pad and brought on the pad to the article labelling station where the label is used to label an article brought forward by the article transport means; and a vacuum distributing valve interposed between the vacuum source and the vacuum control valve for interrupting communication of the vacuum control valve with the vacuum source each time a pad is skipped.

IN THE DRAWINGS

Figure 1:
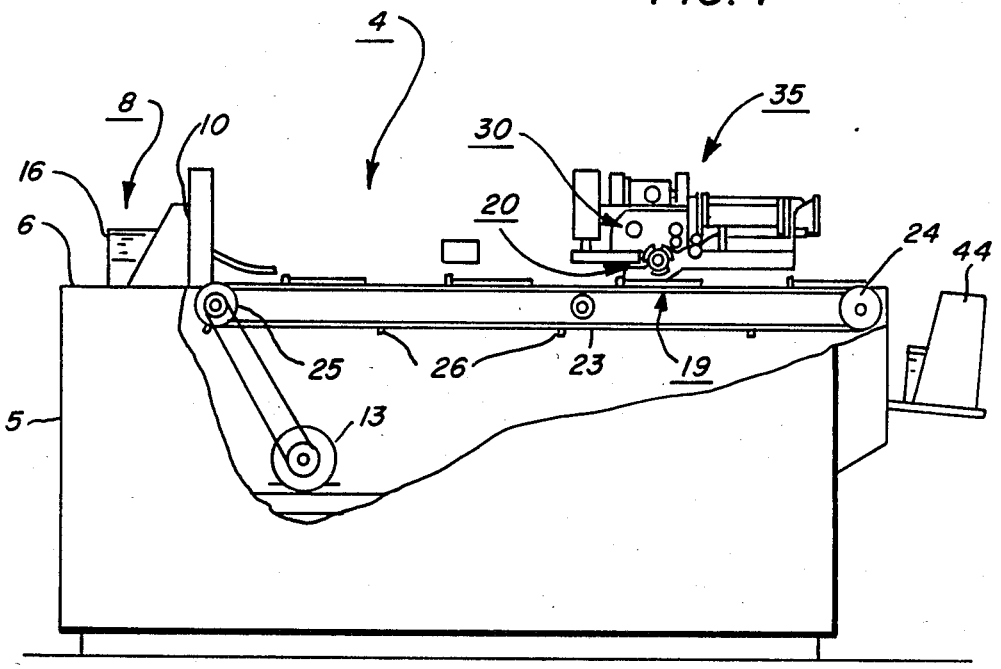
FIG. 1 is a side view of a three pad labelling machine incorporating the vacuum distributing valve of the present invention.
Figure 2:
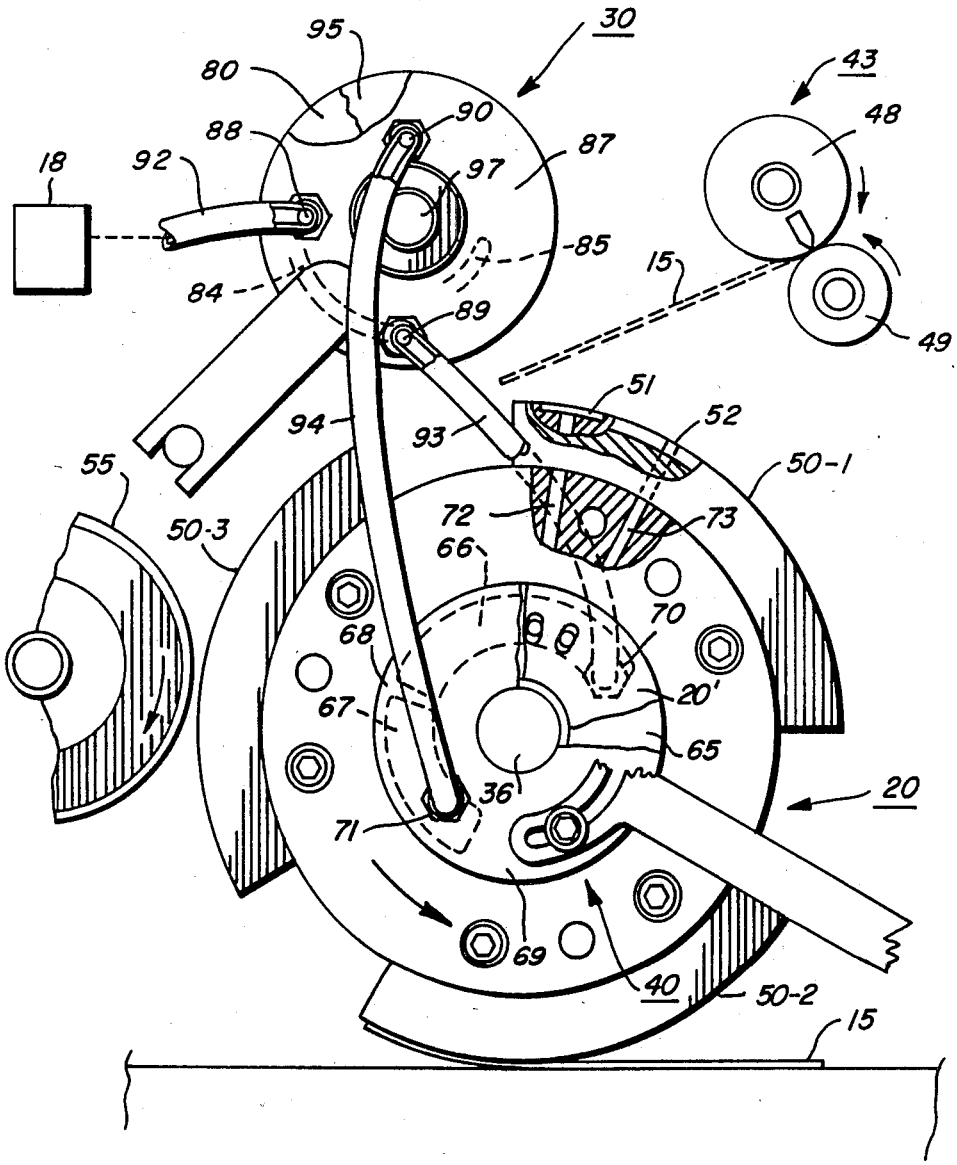
FIG. 2 is an enlarged view in partial cross-section showing details of the labelling machine vacuum control valve for distributing vacuum to the label wheel pads in a controlled manner.
Figure 3:
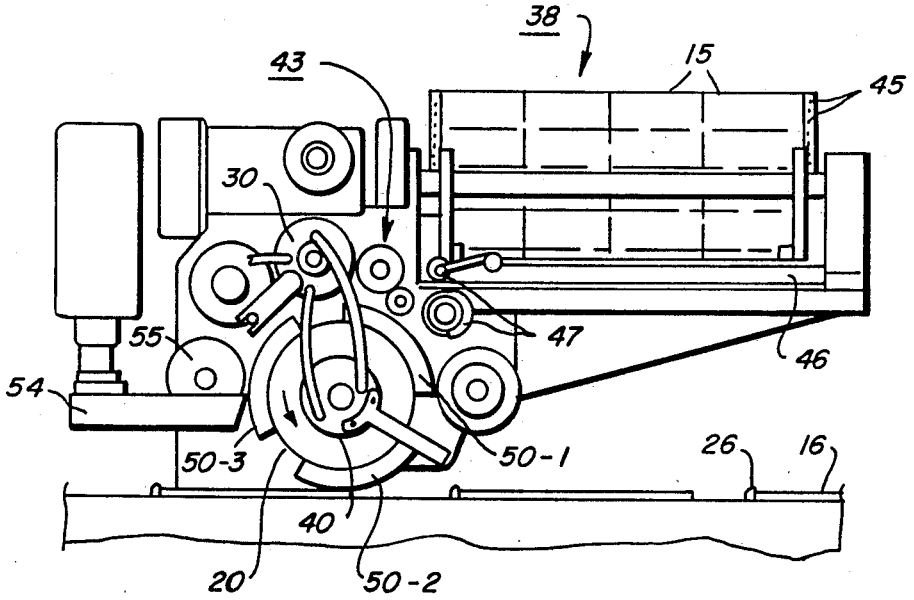
FIG. 3 is a view of the labelling head for the labelling machine shown in FIG. 1 depicting details of the label form feeding and label cutting mechanism.

Referring to FIGS. 1–3, there is shown a labelling machine 4 having a three pad labelling head 35 of the type adapted to incorporate the vacuum distributing valve, identified by the numeral 30, of the present invention. Labelling machine 4 includes a base 5, with a flat table-like upper surface 6 on which the labelling components are supported. An article supply magazine 8 for articles 16 to be labelled which may for example comprise envelopes, magazines, and the like, is provided adjacent one end of base 5. Article magazine 8 has adjustable sides 10 to accommodate different size and types of articles 16.

Articles 16 are fed from article magazine 8 to an article feeding belt 23 and labelling head 35 by a suitable article feeder means such as a reciprocating slider plate with vacuum assist (not shown), the article feeder means being driven by a suitable drive motor 13 in timed synchronization with article feeding belt 23 and labelling head 35. Belt 23 which has lugs 26 for engaging the articles, is supported by rollers 24, 25 on base 5, belt 23 transporting the articles 16 fed from magazine 8 to a labelling station 19 opposite head 35. One feeding belt support roller 25 is drivingly coupled to motor 13.

Labelling head 35 is mounted on base 5 with label wheel 20 spaced opposite to the surface 6 of base 5 at a labelling station 19. Head 35 has a rotatable shaft 36 supporting the label wheel 20, wheel 20 laying in a plane parallel to the direction of movement of articles on feeding belt 23. Label wheel 20 has three label pads 50-1, 50-2, 50-3 spaced evenly about the circumference thereof.

Head 35 includes a label feeding and cutting apparatus for supplying individual labels 15 to labelling wheel 20 from a multi-row label form 38 having a pair of driving sprockets (not shown) which engage perforations 45 in the side margins of label form 38 to advance the label form 38 forward to a guillotine type knife 46. Suitable slitters (not shown) are provided for removing the side margins containing perforations 45 of label form 38 prior to form 38 reaching guillotine knife 46. Knife 46 cuts the label form 38 into elongated strips of several labels each, the number of labels in each being equal to the number of label rows across form 38. The strip of labels from guillotine knife 46 is advanced by strip feeding roll pair 47 to a rotary knife 43 consisting of cooperating knife and anvil rollers 48, 49 respectively. Rotary knife 43 cuts the label strip into individual labels 15, the cut labels being discharged to label pad 50-1, 50-2, 50-3 on wheel 20 as will appear.

Label wheel shaft 36, the label form drive sprockets, guillotine knife 46, strip feed roll pair 47 and rollers 48, 49 of rotary knife 43 are drivenly coupled to motor 13 so as to operate in predetermined timed synchronization with the feeding of articles 16 from article supply magazine 8 to assure the correct labelling of each article 16 is brought forward by article feeding belt 23. Following labelling, the labelled articles are discharged by feed belt 23 to a suitable output device such as hopper 44.

In the exemplary labelling machine shown, the individual labels 15 are affixed to articles 16 by means of adhesive. For this purpose, a suitable glue supply 54 wih rotatable glue wheel 55 is provided. Glue wheel 55 is positioned so as to contact the back side or face of the label as the label is carried therepast on label pads 50-1, 50-2, 50-3 of label wheel 20, wheel 55 applying a relatively thin coating of adhesive to each label. While glue type labelling is shown and described herein, other forms of label transfer such as heat activated adhesive may be contemplated.

Figure 4:
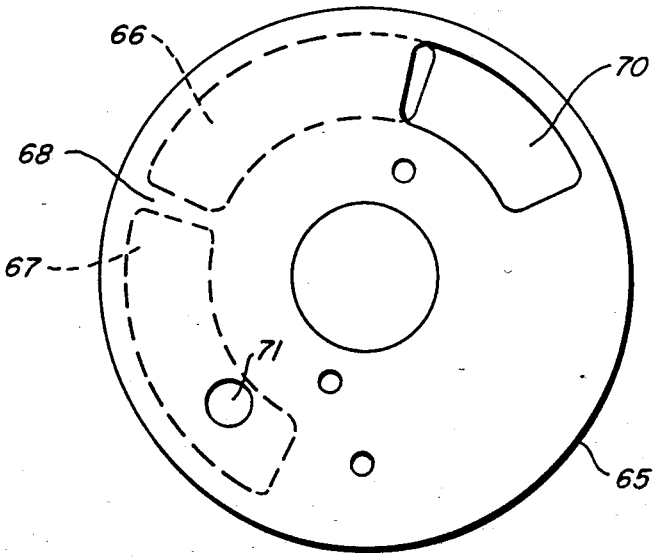
FIG. 4 is an enlarged view showing the valve disc for the vacuum control valve shown in FIG. 2.

Referring particularly to FIGS. 2 and 4, a pair of vacuum holddown ports 51, 52 open to the surface of each label pad 50-1, 50-2, 50-3 at predetermined spaced points therealong. As will appear, vacuum is admitted in progression to ports 51, 52 as the label pad comes opposite the label discharge point of rotary knife 43 to grasp and attach the freshly cut label 15 to the label pad. The rotation of label wheel 20 carries the label on the label pad past glue wheel 55 where adhesive is applied to the label and then into pressure contact with the article being labelled. As the label is transferred to the article being labelled, vacuum to ports 51, 52 is progressively terminated.

To control communication of holddown ports 51, 52 in label pads 50-1, 50-2, 50-3 with vacuum source 18, a vacuum control valve 40 is provided. Valve 40 has a stationary valve disc 65 with cylindrical vacuum chambers or ports 66, 67 separated by a land 68 therein. Fittings 70, 71 communicate ports 66, 67 with vacuum source 18 as will appear. Label wheel 20 has pairs of vacuum passages 72, 73 communicating with holddown ports 51, 52 of each label pad 50-1, 50-2, 50-3. The inside surface of valve disc 65 is in sealed slidable abutting engagement with the outside face 20' of labelling wheel 20, with the inlet to passages 72, 73 terminating at a point opposite ports 66, 67. As a result, the relative rotation that occurs between wheel 20 and valve disc 65 opens vacuum holddown ports 51, 52 to vacuum ports 66, 67 for a predetermined number of degrees during each revolution of wheel 20 as will appear. Manifold 69 seals the outside surface of valve disc 65 with vacuum lines 93, 94 connecting fittings 70, 71 respectively with the vacuum source being attached thereto.

As shown in FIG. 2, valve disc 65 and ports 66, 67 therein are dimensioned and located so that as each label pad approaches the point where a label is discharged by rotary knife 43, first vacuum port 51 is initially opened to vacuum port 66 of valve 40. Thereafter, following a predetermined rotation of wheel 20, the second vacuum port 52 is opened to port 66. The resulting progressive admission of vacuum to ports 51, 52 serves to first grasp and attach the leading edge of the label discharged by rotary knife 43 to the label pad followed by the body of the label. The label 15 is held on the label pad by vacuum as the wheel 20 rotates, with the vacuum supply being shifted during rotation from vacuum port 66 of valve 40 to port 67 for each port 51, 52 in succession as the vacuum passages 72, 73 pass over land 68 of valve disc 65. As the label pad brings the leading edge of the label into transfer relation with the article at labelling station 19, the vacuum supply first to port 51 and then to port 52 is closed off to release the label.

One purpose and advantage of a three pad labelling wheel is the ability to label on centers set by the distance between every other label pad. In that mode of operation, and starting with a label on pad 50-1, pad 50-2 is skipped , pad 50-3 has a label, pad 50-1 (on the next revolution of label wheel 20) is skipped, pad 50-2 has a label, and so forth and so on. However, where there is no label, the holddown ports 51, 52 of the pad are open to the atmosphere during the portion of the cycle when the pad would normally bear a label. This results in a substantial loss of vacuum which in turn requires a larger and more expensive vacuum source 18. For example, if the vacuum source comprises a vacuum pump, a larger capacity pump or a second supplemental pump is required to makeup the vacuum loss. Reducing the arcuate extent of manifolds 66, 67 so that the vacuum 'on time' is less than 120° is normally not possible without a complete redesign and re-manufacture of the labelling machine 4.

Figure 5:
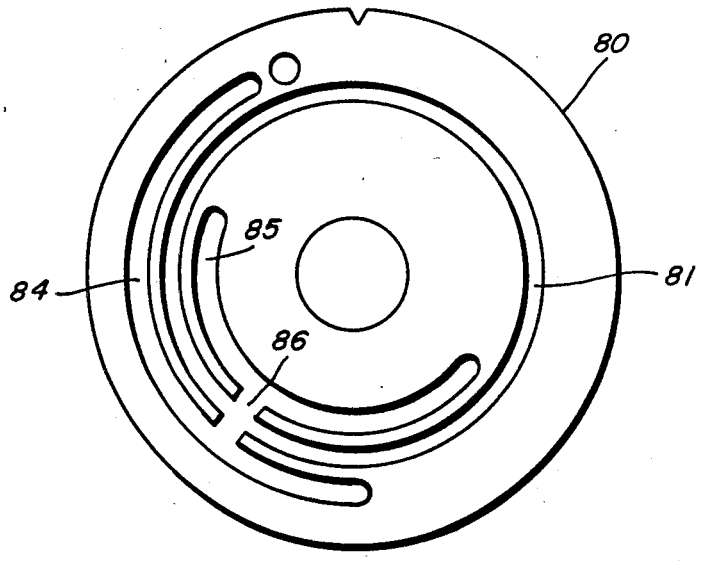
FIG. 5 is an enlarged view of the valve disc for the vacuum distributing valve of the present invention; and FIGS. *6a–6h* are views showing the operating sequence of the vacuum control and vacuum distributing valves through one label pick up and transfer cycle.
Figures 6A, 6B, 6C:
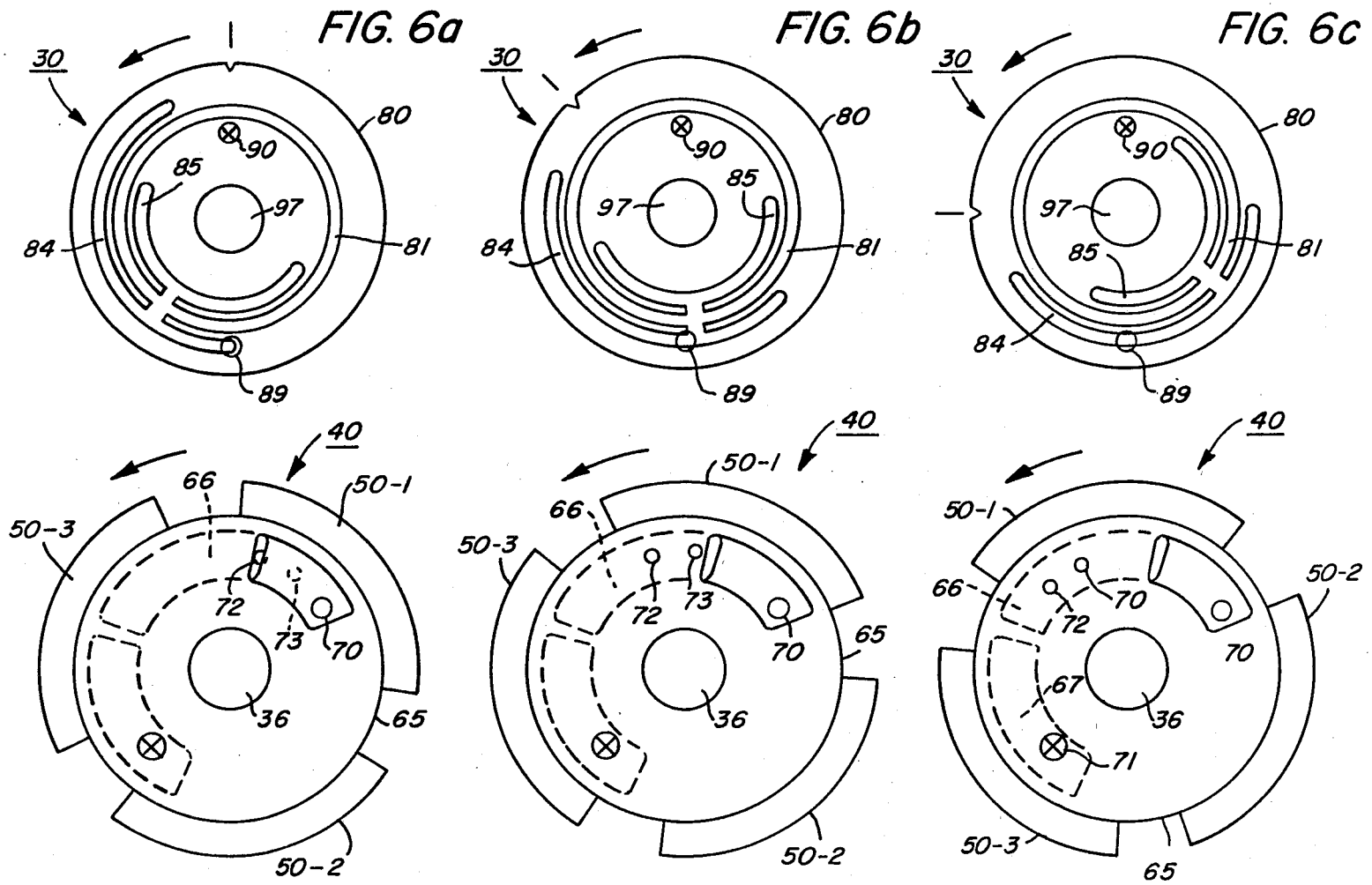
Figures 6D, 6E, 6F:
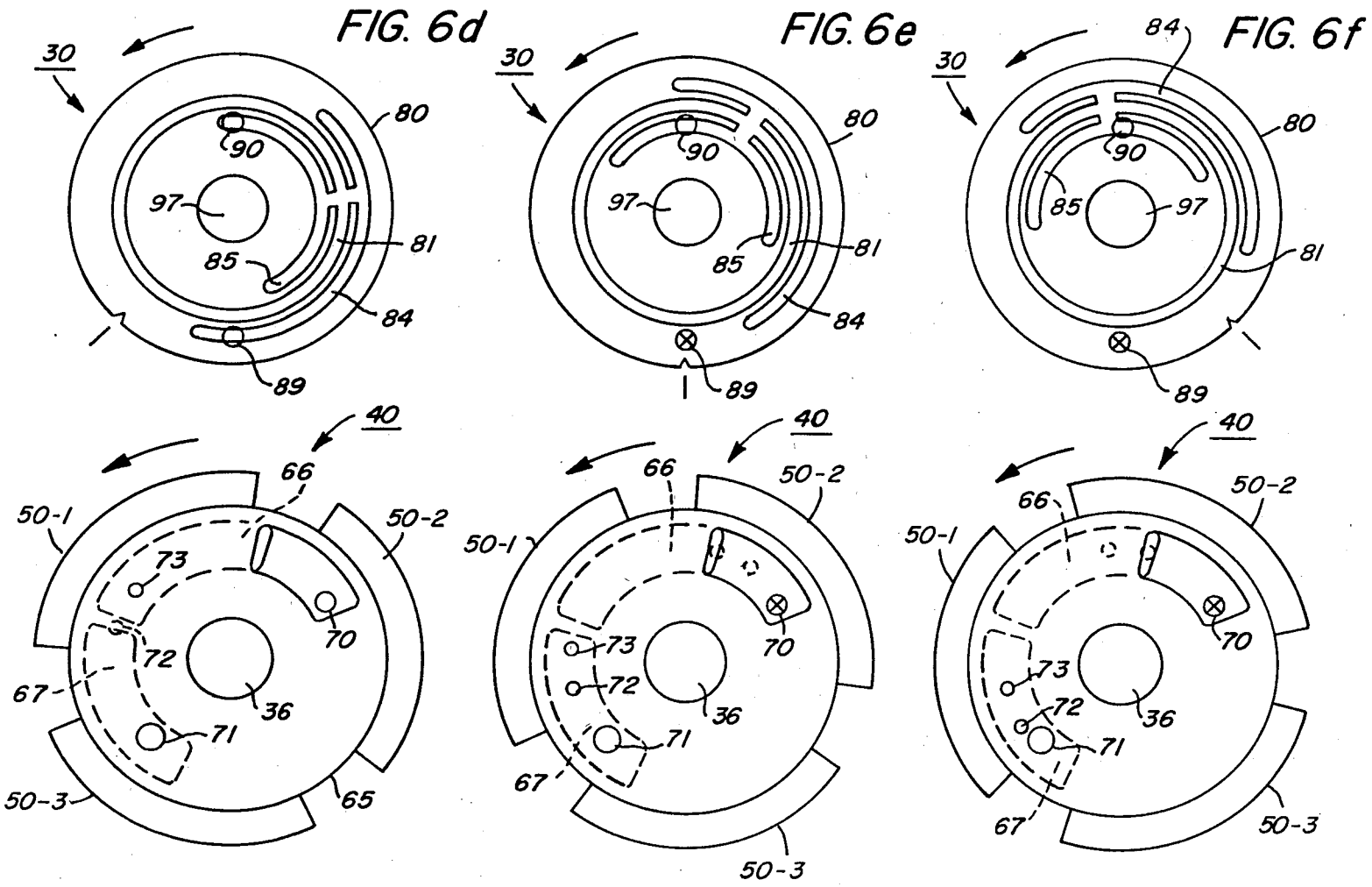
Figure 6H:
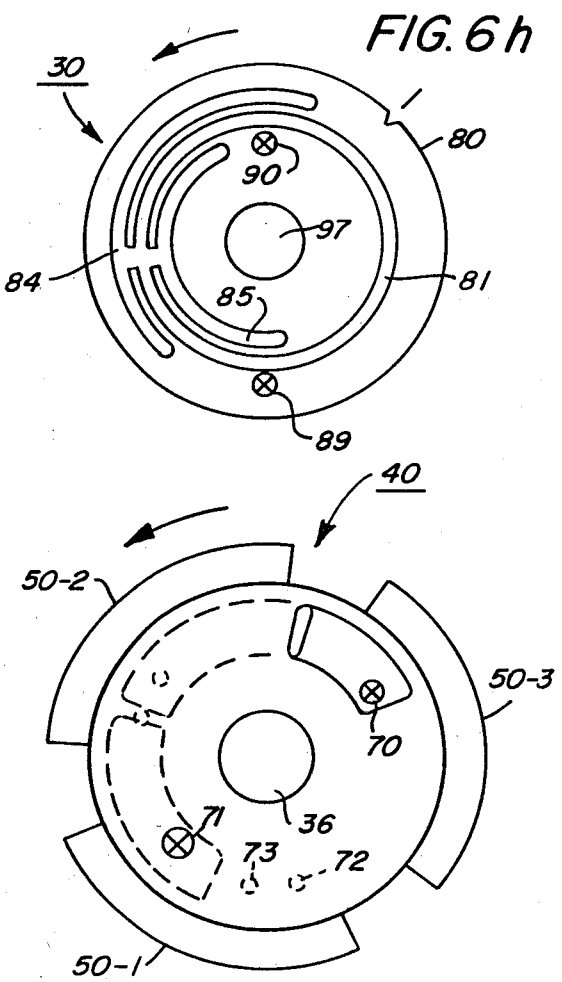
Figure 6G:
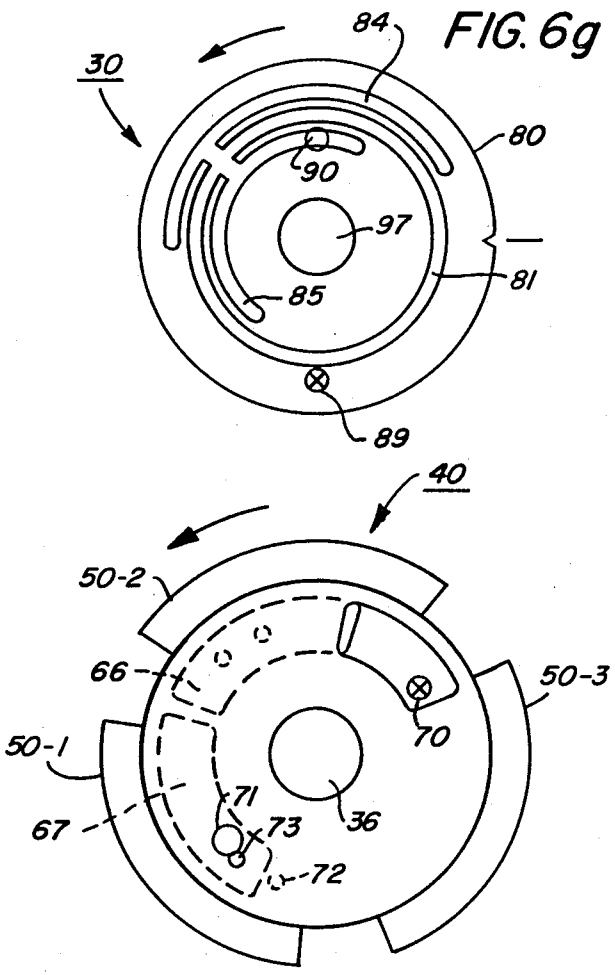

To obviate the above and avoid the loss of vacuum and consequent need for a larger and more costly vacuum source or a major redesign of the machine, the invention provides a vacuum distributing valve 30 to interrupt vacuum to valve 40 each time a label pad is skipped. Referring particularly to FIGS. 2 and 5, vacuum distributing valve 30 has a rotatable valve disc 80 with a central circular vacuum supply manifold 81 therewithin. A vacuum distributing chamber or manifold 84, 85 of predetermined arcurate length is provided on each side of vacuum supply manifold 80, distributing manifolds 84, 85 communicating with supply manifold 81 through connecting passage 86. One side of valve disc 80 is sealing and slidably abutted against a plastic disc 95 which in turn abuts tightly against the surface of a disc-like intake manifold 87. Intake manifold 87 and disc 95 have interconnecting vacuum supply and discharge ports 88 and 89, 90 respectively, which open to vacuum supply manifold 81 and vacuum distributing manifolds 84, 85 respectively of valve disc 80. Vacuum supply port 88 communicates with vacuum source 18 through vacuum line 92 while vacuum discharge ports 89, 90 are coupled to manifolds 66, 67 respectively of vacuum control valve 40 through vacuum lines 93, 94 respectively. The opposite surface of valve disc 80 is solid.

Vacuum distributing valve 30 is mounted on shaft 97 journaled in head 35, shaft 97 being drivingly connected to motor 13 by suitable coupling means (not shown) so as to rotate at a rate 3/2 the rate of rotation of shaft 36 of label wheel 20. Valve disc 80 of valve 30 is drivingly engaged with shaft 36 so as to rotate in unision therewith while intake manifold 87 and plate 95 of valve 30 are journaled on shaft 97 so that shaft 97 rotates relative thereto.

OPERATION

Referring to the drawings and particularly FIGS. *6a–6h*, and presuming operation of labelling machine 4 in the alternate pad labelling mode in which every other label pad on label wheel 20 is skipped, and with pad 50-1 presumed to receive a label, as pad 50-1 approaches the label discharge point of rotary knife 43, valve 30 opens vacuum distributing manifold 84 to vacuum port 66 of valve 40 through port 89, line 93, and fitting 70 as shown in FIG. *6a*. Accordingly as label holddown port 51 of pad 50-1 passes the label discharge position of knife 43, control valve 40 first opens vacuum passage 72 of pad 50-1 to vacuum port 66 followed by vacuum passage 73 as shown in FIG. *6b*. The vacuum provided to port 51 of pad 50-1 attracts and attaches the leading edge of the label 15 to pad 50-1 as the label is discharged by rotary knife 43 while the vacuum to label holddown port 52 grasps and attaches the body of the label to pad 50-1.

As wheel 20 rotates, the label is carried by pad 50-1 past glue wheel 55 where a coating of adhesive is applied to the back side thereof as shown in FIG. *6c*. As the pad 50-1 bearing the label moves toward labelling station 19, communication of the vacuum passage 72 of label holddown port 52 is switched from vacuum port 66 of valve 40 to vacuum port 67 as the inlet to passage 72 passes over land 68 as shown in FIGS. *6d* and *6e*. Thereafter, vacuum passage 73 is similarly switched over to port 67. It will be understood that the momentary interruption of vacuum to ports 51, 52 as switching takes place is of such a limited duration as to have no appreciable effect on the attachment of the label 15 to pad 50-1. Prior to switching of the vacuum passage 72 from vacuum port 66 to vacuum port 67 of valve 40, distributing valve 30 communicates vacuum discharge port 90 with vacuum port 67 to provide vacuum through vacuum line 94 and fitting 71 to the vacuum port 67 of valve 40 as shown in FIG. *6d*. Shortly after that, distributing valve 30 closes off communication between distributing manifold 84 thereof and vacuum port 66 of valve 40 as shown in FIG. *6e*.

As pad 50-1 with the label 15 thereon moves toward and reaches label transfer station 19, control valve 40 closes, in sequence, vacuum passage 72 of label holddown port 51 and then vacuum passage 73 to vacuum port 67 as shown in FIGS. *6f, 6g,* and *6h*. As a result, the label 15 on pad 50-1 is progressively released as the label is being transferred to the article 16 brought forward in timed relation therewith by article feeding belt 43.

Following switching of label holddown port 52 from vacuum manifold 66 of valve 40 to vacuum port 67, distributing valve 30 interrupts communication of vacuum distributing port 89 with vacuum distributing manifold 84 (FIG. *6e*). As a result, the vacuum supply port 66 of valve 40 is interrupted to prevent opening of the label holddown ports 51, 52 of the next succeeding pad 50-2 on labelling wheel 20 to vacuum by valve 40 as that pad reaches the label discharge point of rotary knife 43. After control valve 40 has closed passage 73 of label holddown port 52 of the preceding pad 50-1 to vacuum, distributing valve 30 interrupts communication of vacuum distributing port 90 thereof with vacuum distributing manifold 85 to cut off the vacuum supply to port 67 of valve 40 (FIG. *6h*). With vacuum to ports 66, 67 of valve 40 shut off by valve 30, no vacuum can be admitted to the label holddown ports 50, 51 of pad 50-2 by valve 40. This prevents the loss of vacuum through ports 50, 51 of pad 50-2, which are open to the atmosphere in the absence of a label as the pad 50-2 moves from the point where rotary knife 43 discharges a label to labelling station 19. It will be understood that the operative spacing between glue wheel 55 and the periphery of the label pad passing thereby is such that glue wheel 55 does not contact the label pad in the absence of a label thereon to avoid the application of adhesive to the label pad itself.

As the next label pad 50-3 nears the label discharge point of rotary knife 43, distributing valve 30 communicates the vacuum discharge port 89 thereof with vacuum distributing manifold 84 which in turn opens vacuum port 67 of valve 40 to vacuum (FIG. *6a*). Accordingly, as described heretofore, vacuum is admitted by valve 40 in timely fashion to the label holddown ports 51, 52 of pad 50-3 to attract and attach the label discharged by knife 43 to pad 50-3. Pad 50-3 carries the label past glue wheel 55 where adhesive is applied and into transfer relation with the next article 16 brought forward by article feeding belt 23, control valve 40 functioning to progressively shut off vacuum to ports 51, 52 of pad 50-3 as transfer of the label from pad 50-3 to the article takes place. Concurrently, as desribed before, vacuum distributing valve 30 interrupts communication of valve 40 with vacuum source 18 as the the next label pad 50-1 nears the label pick-up point adjacent rotary knife 43.

While the invention has been described with reference to the structure disclosed, it is not confined to the details set forth, but is intended to cover such modifications or changes as may come within the scope of the following claims.

I claim:

1. In an article labelling apparatus having an article labelling station whereat articles are labelled, a supply of articles to be labelled, article transport means for transporting said articles to said article labelling station for labelling, a label supply station, and means to supply individual labels to said label supply station, the combination of:

(a) a rotary labelling wheel operatively disposed between said label supply station and said article labelling station, said wheel having three discrete labelling pads disposed about the periphery of said wheel, each of said pads having at least one vacuum holddown port open to the periphery thereof for picking up a label and bringing the label into labelling relationship with an article to be labelled at said article labelling station;

(b) a source of vacuum;

(c) a vacuum control valve for communicating the label holddown port of said pads with said vacuum source to cause said pads to pick up and bring a label from said label source to said article labelling station, said vacuum control valve terminating said vacuum communication to release the label and permit transfer of the label to said article; and (d) a vacuum distributing valve interposed between said vacuum source and said vacuum control valve for interrupting communication between said vacuum control valve and said vacuum source for every other label pad whereby to cause every other label pad to skip a label while avoiding loss of vacuum through communication of the open label holddown port with the atmosphere.

2. The apparatus according to claim 1 in which (a) said vacuum control valve includes (1) first and second chambers for supplying vacuum to the holddown ports of said pads, and (2) a valve element for communicating said first chamber with the vacuum holddown port of each successive labelling pad to provide vacuum for picking up and attaching a label to each pad, said valve element switching from the first to the second chamber as each pad carries the label thereon to said labelling station, said valve element thereafter interrupting communication of each pad label holddown port with said second chamber to free the label for transfer from the pad to the article being labelled;

(b) said vacuum distributing valve including (1) first and second chambers, (2) vacuum conduit means coupling the first and second chambers of said vacuum distributing valve with the first and second chambers of said vacuum control valve respectively, and (3) a valve element for controlling communication of the first and second chambers of said vacuum distributing valve with the first and second chambers of said vacuum control valve to skip every other pad, said last mentioned valve element interrupting communication between the first chamber of said vacuum control valve and the first chamber of said vacuum distributing valve before said vacuum control valve communicates the first chamber of said vacuum control valve with the holddown port of the next pad while retaining communication between the second chamber of said vacuum distributing valve and the second chamber of said vacuum control valve to assure vacuum to the previous pad holddown port until transfer of the label carried by the previous pad to the article is completed.

3. In an article labelling apparatus having a three pad head for labelling articles using every other pad to achieve desired center-to-center spacing between the articles being labelled, said pads being mounted in predetermined spaced relation on a rotating label wheel, each of said pads having at least one vacuum holddown port for temporarily attaching a label from a label source to the pad to enable the pad to bring the label thereon to an article to be labelled, the combination of:

(a) a source of vacuum;

(b) a first vacuum valve for distributing vacuum to the holddown port of each pad individually in timed relation with rotation of said label wheel from a label pick up point adjacent said label source to a labelling point where the article is labelled whereby said pad picks up a label and transports said label to the article being labelled, the arcurate distance between said label pickup point and said article labelling point being greater than 180°; and p1 (c) a second vacuum distributing valve for controlling communication of said first valve with said vacuum source in timed relation with rotation of said label wheel so as to admit vacuum to said first valve in time for said first valve to provide vacuum to the label holddown port of one of said pads and enable a label at said label pick up point to be picked up by said one pad for transport by said one pad to the article being labelled while closing off vacuum to said first valve in time to prevent said first valve from providing vacuum to the next pad following said one pad.

4. The apparatus according to claim 3 in which said first valve includes a pair of discrete vacuum supply chambers communicable in succession with said one pad holddown port;

said second valve including a vacuum supply chamber for each of said vacuum supply chambers of said first valve;

said second valve controlling communication between each of said second valve vacuum supply chambers and the associated vacuum supply chamber of said first valve.

* * * * *